United States Patent [19]

Sjöström

[11] 4,104,936

[45] Aug. 8, 1978

[54] HOLDING-ON DEVICE

[76] Inventor: Otto Einar Sjöström, Ekedalsgatan 44 B, S-414 68 Goteborg, Sweden

[21] Appl. No.: 735,495

[22] Filed: Oct. 26, 1976

[30] Foreign Application Priority Data

Oct. 31, 1975 [SE] Sweden ..... 7512218

[51] Int. Cl.[2] ..... B25B 13/58

[52] U.S. Cl. ..... 81/180 R

[58] Field of Search ..... 81/177 A, 177 PP, 177 ST, 81/180 R

[56] References Cited

U.S. PATENT DOCUMENTS

| | | | |
|---|---|---|---|
| 2,156,285 | 5/1939 | Harris | 81/177 A |
| 3,839,929 | 10/1974 | Richards | 81/177 PP |

FOREIGN PATENT DOCUMENTS

| | | | |
|---|---|---|---|
| 380,516 | 12/1970 | U.S.S.R. | 81/180 R |

*Primary Examiner*—James L. Jones, Jr.
*Assistant Examiner*—James G. Smith

[57] ABSTRACT

The holding device of the present invention, facilitates the tightening of a screw joint projecting from both sides of a pair of plates. The device includes an arm which at one end thereof, features an organ for a torque transmitting engagement with a part belonging to the screw joint, and at the other end features a lateral stop which includes a cam body or eccentric assembly designed to abut against an edge of at least one plate or flange. Once the tightening operation is completed, the device is adaptable to readily disengage the arm from the screw joint.

4 Claims, 1 Drawing Figure

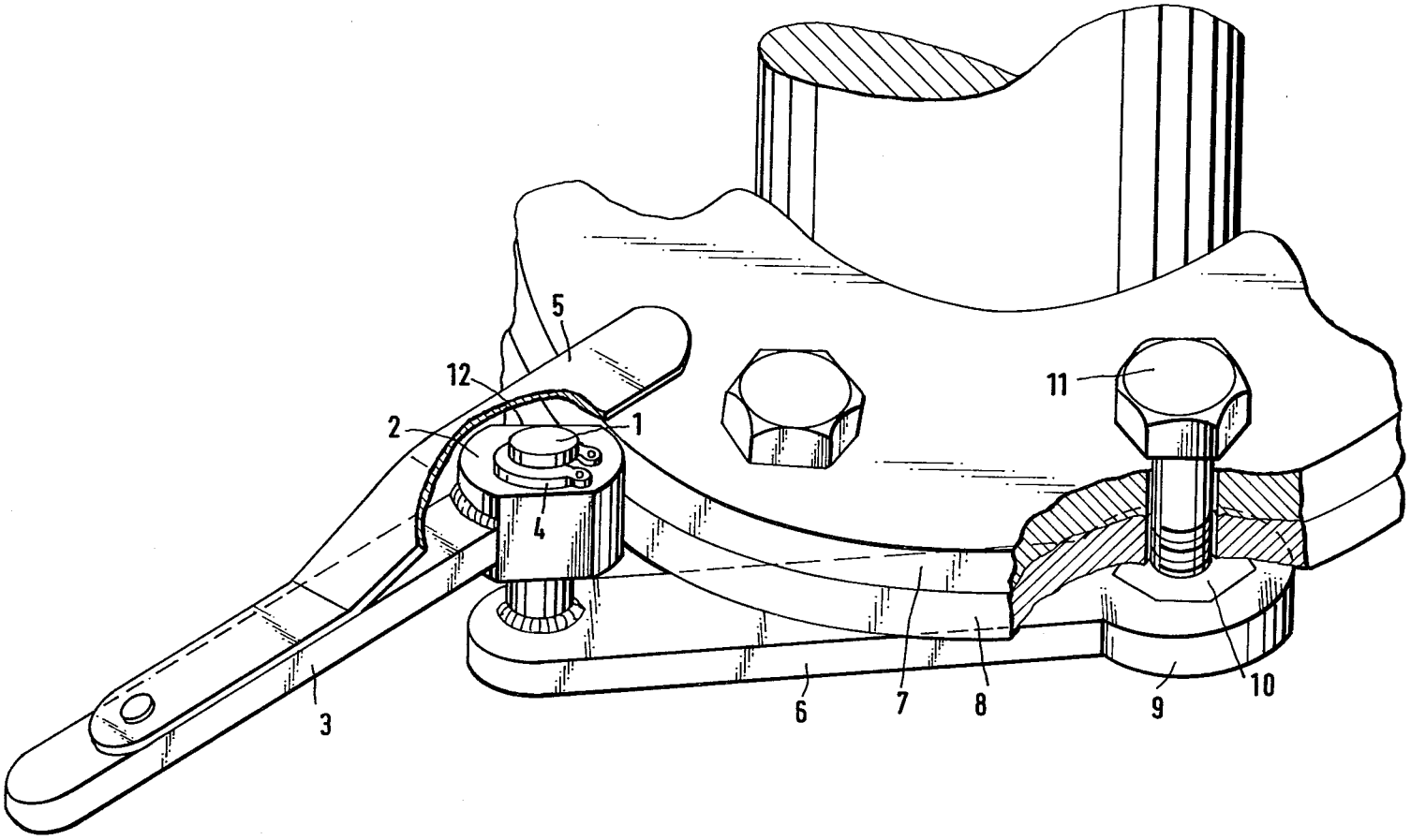
1
2
3
4
5
6
7
8
9
10
11
12

HOLDING-ON DEVICE

The invention relates to a holding device serving the purpose to facilitate the tightening of a screw joint projecting from both sides of a pair of plates or flanges, which device comprises an arm, which at one end exhibits an organ for a torque transmitting engagement with a part belonging to the screw joint, and at the other end exhibits a lateral stop designed to abut against an edge of at least one plate or flange.

In a known holding device of this type the lateral stop comprises a pin or bar rigidly fixed to the arm. In this device the drawback arises that the torque transmitted by the organ of engagement of the holding-on device to the screw joint at least to a substantial degree remains permanent after finishing the tightening operation thereby causing a locking by friction between said organ of engagement and the part of the screw joint engaging the same. This makes it difficult to remove the holding device. The difficulty increases according to the dimension of the screw and the torque.

It is an object of the invention to eliminate the above mentioned drawback, and to this effect the invention is characterized by the feature that the lateral stop comprises a cam body or eccentric, which is manually pivotable and preferably journaled on a pin on the arm. When the device is used, this cam or eccentric is placed in a low position relative to the cooperating edge of the plate or flange. After finished tightening of the screw joint, the cam body or eccentric is pivoted towards a high position and subsequently back again to the low position. The engaging organ is then free of torque and loosens, or can easily be loosened from the part of the screw joint engaging the same.

A perspective view of a holding device constituting an example of an embodiment of the invention in practice is illustrated in the accompanying drawing.

In the figure the device is shown in mounted condition on a pair of flanges 7, 8, which shall be connected by means of screw bolts. The device comprises an arm 6, which at one end exhibits a gripping head 9, and at the other end is provided with a pin 1, which is fastened by welding, on which pin a cam body or eccentric 2 is pivotably journaled. The gripping head 9 is designed as a hexagonal key adapted to the nut 10, which shall be kept immobile, while the cooperating screw bolt 11 is tightened by means of a tightening tool. The cam body

2 with its lower portion abuts against a shoulder on the pin 1 and is retained on the pin by means of a locking spring engaging a groove in the pin. A handle arm or bar 3 is welded to the cam body, and a plate spring 5 is in its turn fastened on said bar 3 and extends in over the upper flange 7 against which it abuts in springing fashion, whereby the arm 6 and its head 9 are kept abutting against the lower flange 8.

Before the tightening of the screw 11, the cam body 2 is set in a low position relative to the edge of the flanges 7, 8, i.e. in such a manner that is chamfered portion 12 is facing said edge. After the tightening of the screw 11 is finished, the cam body 2 by means of the handle arm 3 is pivoted a certain distance away from the low position, so that the pin 1 is displaced somewhat away from the edge of the flanges 7, 8, while the arm 6 is simultaneously pivoted. Thereafter the cam body is immediately pivoted back to the low position. As the cam body then no longer engages the edge of the flanges 7, 8 and thus no torque is transmitted from the gripping head 9 to the nut 10, the gripping head can now easily be brought out of engagement with the nut 10.

What is claimed is:

1. A holding device for facilitating the tightening of a screw joint projecting from both sides of a pair of plates, which device comprises an arm, having at one end, an organ for a torque transmitting engagement with a part belonging to the screw joint, and at the other end, a lateral stop designed to abut against an edge of at least one plate, characterized by said lateral stop comprising a pin affixed to the other end of said arm and a manually pivotable eccentric journaled on said pin.

2. A holding device according to claim 1, characterized by a handle bar rigidly attached to said eccentric for the pivoting thereof.

3. A holding device according to claim 1, characterized by a plate spring attached to said lateral stop in such a manner, that said plate spring forms one leg of a clamp, the other leg of which, being formed by said arm, both legs arranged to bestride the edges of the plates.

4. A holding device according to claim 2, characterized by a plate spring fastened to said handle bar, said plate spring extending over and abutting against an upper plate, and said arm abutting against a lower plate.

* * * * *